US007701432B2

(12) United States Patent
Kim et al.

(10) Patent No.: US 7,701,432 B2
(45) Date of Patent: Apr. 20, 2010

(54) ROUTING SIGNALS TO DRIVERS OF DISPLAY DEVICE WITH MINIMIZED WIRING

(75) Inventors: Kyung-Wol Kim, Seoul (KR); Yong-Weon Jeon, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1233 days.

(21) Appl. No.: 11/241,270

(22) Filed: Sep. 30, 2005

(65) Prior Publication Data

US 2006/0114217 A1 Jun. 1, 2006

(30) Foreign Application Priority Data

Dec. 1, 2004 (KR) ..... 10-2004-0099723

(51) Int. Cl.
*G09G 3/36* (2006.01)

(52) U.S. Cl. ..... 345/100; 345/87; 345/98; 345/99

(58) Field of Classification Search ..... 345/98, 345/99, 100, 87
See application file for complete search history.

(56) References Cited

U.S. PATENT DOCUMENTS 6,407,730 B1 * 6/2002 Hori ..... 345/100
2002/0180684 A1 * 12/2002 Saitou et al. ..... 345/98
2003/0048249 A1 * 3/2003 Sekido et al. ..... 345/98
2003/0117350 A1 * 6/2003 Jun ..... 345/87

OTHER PUBLICATIONS

Japanese Patent Application No. 2002-225153 to Takashi et al, having Publication date of Mar. 4, 2004.
U.S. Appl. No. 11/035,596 entitled *Display Device* filed Jan. 14, 2005 at USPTO.
Taiwanese Patent No. 554316 having Publication date of Sep. 21, 2003.
Taiwanese Patent No. 559770 to Nitta et al., having Publication date of Nov. 1, 2003.

* cited by examiner

*Primary Examiner*—Richard Hjerpe
*Assistant Examiner*—Saifeldin Elnafia
(74) *Attorney, Agent, or Firm*—Monica H. Choi

(57) ABSTRACT

A display device includes a first set of data buses coupled between a timing controller and a first line driver. In addition, the display device also includes a second set of at least one data bus coupled between the first line driver and a second line driver. The second set has a less number of at least one data bus than the first set. Thus, data signals are transmitted to the line drivers of the display panel from the timing controller with minimized wiring for reduced power consumption and electromagnetic interference.

23 Claims, 7 Drawing Sheets

ROUTING SIGNALS TO DRIVERS OF DISPLAY DEVICE WITH MINIMIZED WIRING

CROSS-REFERENCE TO RELATED APPLICATION(S)

The present application claims priority under 35 U.S.C. § 119 to Korean Patent Application No. 2004-99723, filed on Dec. 1, 2004, which is incorporated herein by reference in its entirety.

TECHNICAL FIELD

The present invention relates generally to display devices such as LCD (liquid crystal display) panels, and more particularly, to minimizing signal wiring to drivers in a display device with a large display panel for in turn minimizing EMI (electromagnetic interference) and power consumption.

BACKGROUND OF THE INVENTION

FIG. 1 shows a block diagram of components of a display device 10 such as a TFT-LCD (thin film transistor liquid crystal display) device. The display device 10 includes a display panel 12, a source driver block 14, a gate driver 16, a timing controller 18, and a power source 20.

The display panel 12 includes a plurality of source (i.e., data) lines S1, S2, . . . , and so on to SN. The display panel 12 also includes a plurality of gate (i.e., scan) lines G1, G2, . . . , and so on to GM. The display panel 12 further includes an array of N×M pixel electrodes. Each pixel electrode and a corresponding TFT (thin film transistor) are disposed at an intersection of a respective source line and a respective gate line. Each TFT of the display panel 12 has a gate coupled to a corresponding gate line, a source coupled to a corresponding source line, and a drain coupled to a corresponding pixel electrode.

The source driver block 14 includes multiple source drivers for driving the source lines S1, S2, . . . , and SN with display data (DATA) from the timing controller 18. The timing controller 18 also generates a clock signal (CLK), a data initiation signal (DIO), a load signal (LOAD), and a polarity signal (POL), as control signals to the source driver block 14. The CLK signal is used for signal synchronization between the timing controller and the source driver block 14. The DIO signal is used to indicate when the DATA signal has valid RGB color data. The LOAD signal indicates when the source lines S1, S2, . . . , and SN are to be driven with the RGB color data. The POL signal indicates whether the source driver block should perform inversion on the RGB color data.

The power source 20 generates the bias voltages used by the source driver block 14, the gate driver 16, and the display panel in response to control signals from the timing controller 18. The gate driver 16 sequentially drives the gate lines G1, G2, . . . , and GM in response to control signals from the timing controller 18. In this manner, the pixel electrodes of the display panel 12 are driven with the RGB color data at proper timing for displaying images.

The display panel 12 is desired to be larger with advancement of display technology. Thus, the source driver block 14 is comprised of a plurality of source drivers for driving the large number of source lines of a large display panel 12. The signals from the timing controller 18 are routed to such multiple source drivers with much wiring. Such signal transmission through such increased wiring results in increased power consumption and EMI (electromagnetic interference).

FIG. 2 shows example signal routing from the timing controller 18 to the plurality of source drivers including a first source driver 52, a second source driver 54, and a third source driver 56. Such source drivers 52, 54, and 56 are each disposed on a respective film 62, 64, and 66 comprised of a filler material. Such filler material is individually known to one of ordinary skill in the art. The films 62, 64, and 66 are disposed between the display panel 12 and a PCB substrate 72 having the timing controller 18 mounted thereon. Each of the source drivers 52, 54, and 56 drives a respective set of source lines of the display panel 12.

In the example of FIG. 2, the timing controller 18 generates three bits of red color data R[2:0], three bits of green color data G[2:0], and three bits of blue color data B[2:0], via a total of nine wires from the timing controller 18. The timing controller 18 also generates the control signals for the clock signal CLK and the data initiation signal DIO1. The timing controller 18 further generates a reference signal IREF used by the source drivers 52, 54, and 56 when the data signals R[2:0], G[2:0], and B[2:0] are single-ended.

Further in FIG. 2, a GAMMA voltage which is a reference voltage used by a respective DAC (digital to analog converter) within each of the source drivers 52, 54, and 56 is coupled to such source drivers 52, 54, and 56. In addition, at least one POWER voltage is coupled to each of the source drivers 52, 54, and 56.

In the prior art of FIG. 2, each of the signals R[2:0], G[2:0], B[2:0], CLK, DIO1, and IREF are routed to each of the source drivers 52, 54, and 56. In particular, each bit of the RBG data R[2:0], G[2:0], and B[2:0] are routed sequentially in cascade through the source drivers 52, 54, and 56. Thus, nine wires route the nine color bits R[2:0], G[2:0], and B[2:0] from the timing controller 18 to the first source driver 52. Another nine wires route the nine color bits R[2:0], G[2:0], and B[2:0] from the first source driver 52 to the second source driver 54. Furthermore, another nine wires route the nine color bits R[2:0], G[2:0], and B[2:0] from the second source driver 54 to the third source driver 56.

In the prior art, RGB data is transmitted to the source drivers 52, 54, and 56 via the respective nine wires between the timing controller 18 and the first source driver 52 and the respective nine wires between each adjacent pair of the source drivers 52, 54, and 56. Thus in the prior art of FIG. 2, the wiring for the RGB color data is increased for a larger display panel 12 having a larger number of source drivers. Such increased wiring in turn disadvantageously increases power consumption and EMI (electromagnetic interference) during transmission of such RGB color data.

Thus, RGB color data is desired to be transmitted through the multiple source drivers with minimized wiring for large display panels.

SUMMARY OF THE INVENTION

Accordingly, in a general aspect of the present invention, wiring is minimized for transmitting color data from the timing controller to source drivers, especially disposed further away from the timing controller.

A display device according to an embodiment of the present invention includes a first set of data buses coupled between a timing controller and a first line driver. In addition, the display device also includes a second set of at least one data bus coupled between the first line driver and a second line driver. The second set has a less number of at least one data bus than the first set.

In one embodiment of the present invention, the first and second line drivers are source drivers serially coupled in cascade.

In a further embodiment of the present invention, the first set of data buses transmits data to be used by the first and second line drivers, and the second set of at least one data bus transmits data to be used by the second line driver. For example, the second set of at least one data bus does not transmit data used by the first line driver. In another embodiment of the present invention, the second set of at least one data bus transmits data to be used by a third line driver coupled to the second line driver.

In a further embodiment of the present invention, a respective data bus in each of the first and second sets transmits at least one control signal during a predetermined time period. For example, the at least one control signal indicates at least one of a LATCH state, a LOAD state, and a POLARITY state for the first and second line drivers.

In a method for transmitting data signals in a display device according to another aspect of the present invention, a first set of data signals is transmitted from a timing controller to a first line driver. In addition, a second set of at least one data signal is transmitted from the first line driver to the second line driver. The number of the at least one data signal in the second set is less than in the first set.

In this manner, data signals are transmitted to the line drivers of the display panel from the timing controller with minimized wiring. Such minimized wiring is advantageous for in turn minimizing power consumption and EMI (electromagnetic interference), especially for large display panels having a large number of line drivers.

These and other features and advantages of the present invention will be better understood by considering the following detailed description of the invention which is presented with the attached drawings.

BRIEF DESCRIPTION OF THE DRAWINGS

The figures referred to herein are drawn for clarity of illustration and are not necessarily drawn to scale. Elements having the same reference number in FIGS. 1, 2, 3, 4, 5, 6, and 7 refer to elements having similar structure and function.

DETAILED DESCRIPTION

Figure 3:
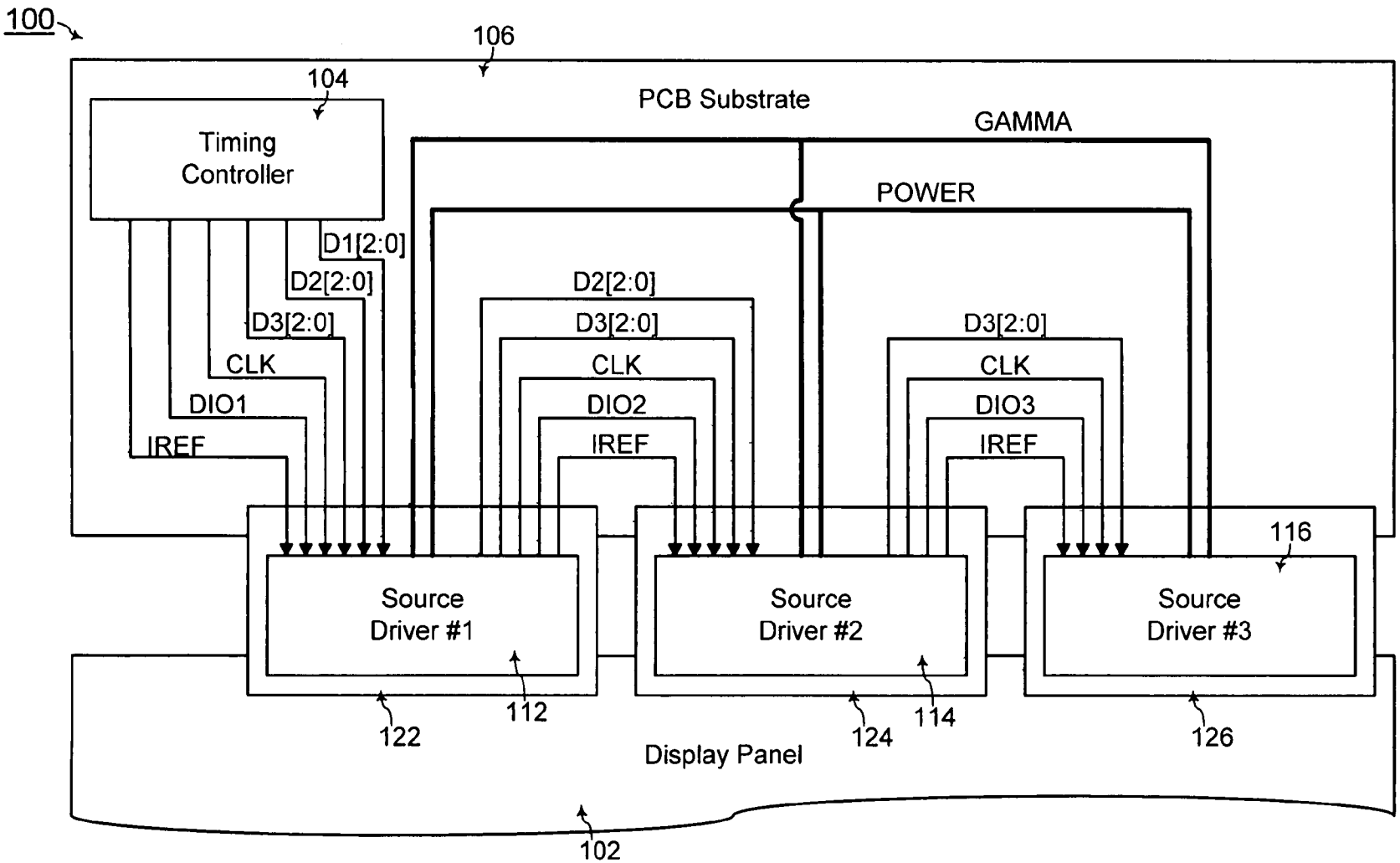
FIG. 3 shows a display device with minimized wiring for signal transmission from a timing controller to source drivers, according to an embodiment of the present invention.

FIG. 3 shows a block diagram of a display device 100 with minimized signal wiring according to an embodiment of the present invention. The display device includes a display panel 102 and also includes a timing controller 104 mounted on a PCB (printed circuit board) substrate 106. The display device additionally includes a plurality of source drivers including a first source driver 112, a second source driver 114, and a third source driver 116.

Each of the source drivers 112, 114, and 116 are disposed on a respective film 122, 124, and 126. The films 122, 124, and 126 are comprised of a filler material to interface the source drivers 112, 114, and 116 between the PCB substrate 106 and the display panel 102. Such filler material is individually known to one of ordinary skill in the art.

Further in FIG. 3, a GAMMA voltage which is a reference voltage used by a respective DAC (digital to analog converter) within each of the source drivers 112, 114, and 116 is coupled to such source drivers 112, 114, and 116. In addition, at least one POWER voltage is coupled to each of the source drivers 112, 114, and 116.

The timing controller generates first RGB color data D1[2:0], second RGB color data D2[2:0], and third RGB color data D3[2:0]. The first RGB color data D1[2:0] is to be used by the first source driver 112 for driving a first respective set of source lines of the display panel 102. The second RGB color data D2[2:0] is to be used by the second source driver 114 for driving a second respective set of source lines of the display panel 102. The third RGB color data D3[2:0] is to be used by the third source driver 116 for driving a third respective set of source lines of the display panel 102. In addition, the timing controller 104 generates control signals including a clock signal CLK, a first data initiation signal DIO1, and a reference voltage signal IREF.

Further referring to FIG. 3, the first, second, and third RGB color data D1[2:0], D2[2:0], and D3[2:0] are transmitted from the timing controller 104 to the first source driver 112. In one embodiment of the present invention, a respective set of three wires are used for transmitting each of the first, second, and third RGB color data D1[2:0], D2[2:0], and D3[2:0]. Thus, a first set of data buses comprised of a total of nine wires for example are used for transmitting the first, second, and third RGB color data D1[2:0], D2[2:0], and D3[2:0] from the timing controller 104 to the first source driver 112 in FIG. 3.

The first source driver 112 drives a respective set of source lines of the display panel 102 from the first RGB color data D1[2:0]. In addition, the first source driver 112 further transmits the second and third RGB color data D2[2:0] and D3[2:0] to be used by the second and third source drivers 114 and 116. Thus, a second set of data buses comprised of a total of six wires for example are used for transmitting the second and third RGB color data D2[2:0] and D3[2:0] from the first source driver 112 to the second source driver 114.

The second source driver 114 drives a respective set of source lines of the display panel 102 from the second RGB color data D2[2:0]. In addition, the second source driver 112 further transmits the third RGB color data D3[2:0] to be used by the third source driver 116. Thus, a third set of data buses comprised of a total of three wires for example are used for transmitting the third RGB color data D3[2:0] from the second source driver 114 to the third source driver 116.

In addition, the clock signal CLK and the reference voltage IREF are transmitted from the timing controller 104 to the first source driver 112, subsequently to the second source driver 114, and subsequently to the third source driver 116. Furthermore, a first data initiation signal DIO1 is transmitted from the timing controller 104 to the first source driver 112. Additionally, a second data initiation signal DIO2 is transmitted from the first source driver 112 to the second source driver 114, and a third data initiation signal DIO3 is transmitted from the second source driver 114 to the third source driver 116.

The IREF voltage is transmitted from the timing controller 104 through the source drivers 112, 114, and 116. The IREF voltage is a reference voltage used by the source drivers 112, 114, and 116 when the data signals D1[2:0], D2[2:0], and D3[2:0] are single-ended signals.

Figure 4:
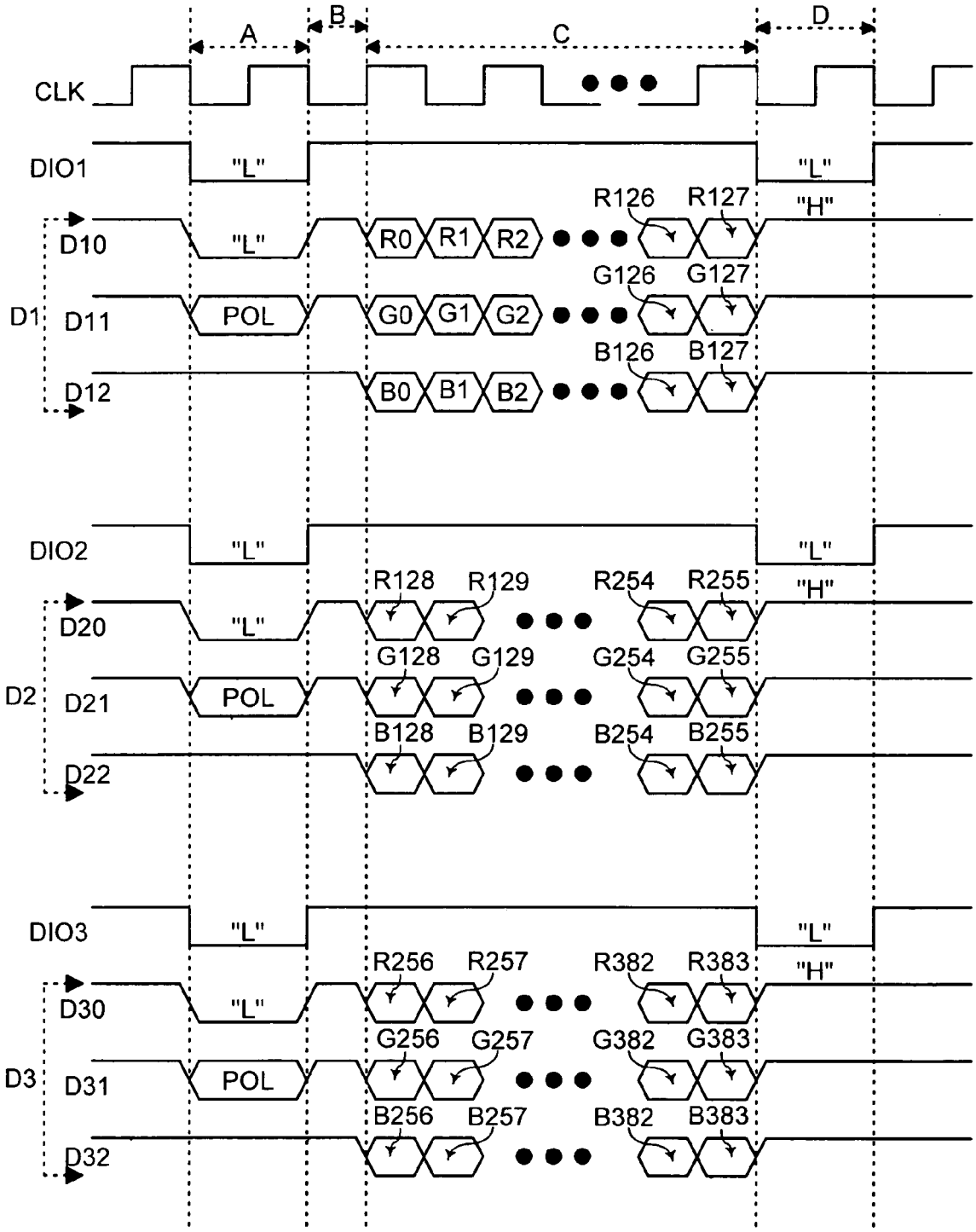
FIG. 4 shows a timing diagram of signals transmitted in the display device of FIG. 3, according to an embodiment of the present invention.

FIG. 4 shows a timing diagram of signals during operation of the components of FIG. 3. Referring to FIG. 4, the clock signal CLK generated from the timing controller 104 is used for synchronizing the timing of operation of the components in FIG. 3. During a time period A of the clock signal CLK, the timing controller 104 deactivate the first data initiation signal DIO1 and a first red data signal D10 each to a logical low state "L". In addition during the time period A, the timing controller 104 sets a first green data signal D11 to a logical state corresponding to the polarity for the first data signals D1[2:0] to follow during the time period C.

Additionally during the time period A, the first source driver 112 copies the first data initiation signal DIO1, the first red data signal D10, and the first green data signal D11 to generate and transmit to the second source driver 114 the second data initiation signal DIO2, a second red data signal D20, and a second green data signal D21, respectively. Furthermore during the time period A, the second source driver 114 copies the second data initiation signal DIO2, the second red data signal D20, and the second green data signal D21 to generate and transmit to the third source driver 116 the third data initiation signal DIO3, a third red data signal D30, and a third green data signal D31, respectively. Thus, in terms of logical states, DIO1=DIO2=DIO3 at the logical low state "L", D10=D20=D30 at the logical low state "L", and D11=D21=D31 at the polarity state "POL", during the time period A.

The combination of a respective data initiation signal DIO and a respective red signal both being at the logical low state "L" indicates initiation of a LATCH state at each of the source drivers 112, 114, and 116 during a time period A. Thereafter, each of the drivers 112, 114, and 116 latches respective RGB data during a time period C.

For example during time period C, red data bits R0, R1, . . . , and so on to R127 are latched within the first source driver 112 via the first red data wire D10; green data bits G0, G1, . . . , and so on to G127 are latched within the first source driver 112 via the first green data wire D11; and blue data bits B0, B1, . . . , and so on to B127 are latched within the first source driver 112 via a first blue data wire D12.

Also during the time period C, red data bits R128, R129, . . . , and so on to R255 are latched within the second source driver 114 via the second red data wire D20; green data bits G128, G129, . . . , and so on to G255 are latched within the second source driver 114 via the second green data wire D21; and blue data bits B128, B129, . . . , and so on to B255 are latched within the second source driver 114 via a second blue data wire D22.

Similarly during the time period C, red data bits R256, R257, . . . , and so on to R383 are latched within the third source driver 116 via the third red data wire D30; green data bits G256, G257, . . . , and so on to G383 are latched within the third source driver 116 via the third green data wire D31; and blue data bits B256, B257, . . . , and so on to B383 are latched within the third source driver 116 via a third blue data wire D32.

During the time period C, the first, second, and third data initiation signals DIO1, DIO2, and DIO3 are set to the logical high state. Thereafter during a time period D, the timing controller 104 sets the first data initiation signal DIO1 to the logical low state "L". Also during the time period D, the first source driver 112 copies the second data initiation signal DIO2 to the logical low state "L" from the first data initiation signal DIO1, and the second source driver 114 copies the third data initiation signal DIO3 to the logical low state "L" from the second data initiation signal DIO2.

Similarly during the time period D, the timing controller 104 sets the first red data signal D10 to the logical high state "H". Also during the time period D, the first source driver 112 copies the second red data signal D20 to the logical high state "H" from the first red data signal D10, and the second source driver 114 copies the third red data signal D30 to the logical high state "H" from the second red data signal D20.

The combination of a respective data initiation signal DIO being set at the logical low state "L" and a respective red signal being set at the logical high state "H" indicates a LOAD state at each of the source drivers 112, 114, and 116 during a time period D. During such a LOAD state, each of the source drivers 112, 114, and 116 drives a respective set of source lines of the display panel 102 with the respective RGB data that was latched during the time period C.

Figure 5:
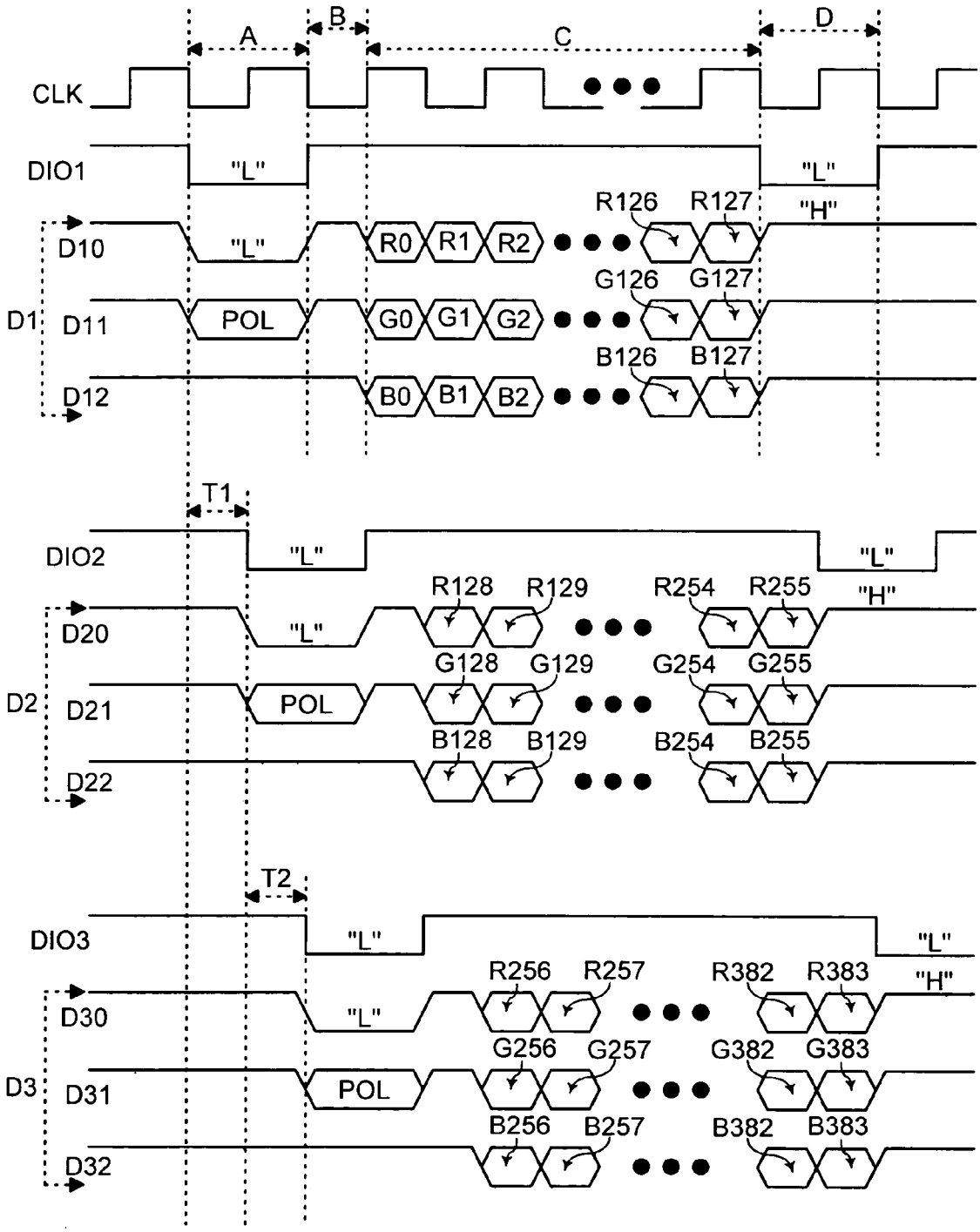
FIG. 5 shows a timing diagram of signals transmitted with delay in the display device of FIG. 3, according to another embodiment of the present invention.

FIG. 5 shows a timing diagram of signals during operation of the components of FIG. 3 according to another embodiment of the present invention. FIGS. 4 and 5 are similar, but FIG. 5 also shows a delay between data initiation signals and RGB data signals as such signals are copied and transmitted through the source drivers 112, 114, and 116 serially in cascade. Such delay may be generated from the time required for copying such signals at a source driver for transmission to a subsequent source driver in the serial cascade.

For example in FIG. 5, the second data initiation signal DIO2 and the second RGB data signals D20, D21, and D22 received at the second source driver 114 are delayed by a delay amount T1 from the first data initiation signal DIO1 and the first RGB data signals D10, D11, and D12 at the first source driver 112. Similarly, the third data initiation signal DIO3 and the third RGB data signals D30, D31, and D32 received at the third source driver 116 are delayed by a delay amount T2 from the second data initiation signal DIO2 and the second RGB data signals D20, D21, and D22 at the second source driver 114.

Such delays T1 and T2 are illustrated as being ½ of a cycle of the clock signal CLK in FIG. 5 for convenience of illustration. However, such delays T1 and T2 in reality would typically be a finite number of cycles of the clock signal CLK. With such delays in FIG. 5, the above-described latching and loading are performed with such corresponding delays in the second and third source drivers 114 and 116.

In any case of FIGS. 4 or 5, signal wiring is minimized for the RGB data signals in FIG. 3. Such minimized signal wiring results in reduced power consumption. For example, assume that a total current I is consumed for signal transmission through the data buses for the RGB data signals D1[2:0], D2[2:0], and D3[2:0] from the timing controller 104 to the first source driver 112. In that case, the total current consumed for signal transmission through the data buses for the RGB data signals D2[2:0] and D3[2:0] from the first source driver 112 to the second source driver 114 is (⅔)*I. Furthermore, the total current consumed for signal transmission through the data buses for the RGB data signals D3[2:0] from the second source driver 114 to the third source driver 116 is (⅓)*I.

Figure 1:
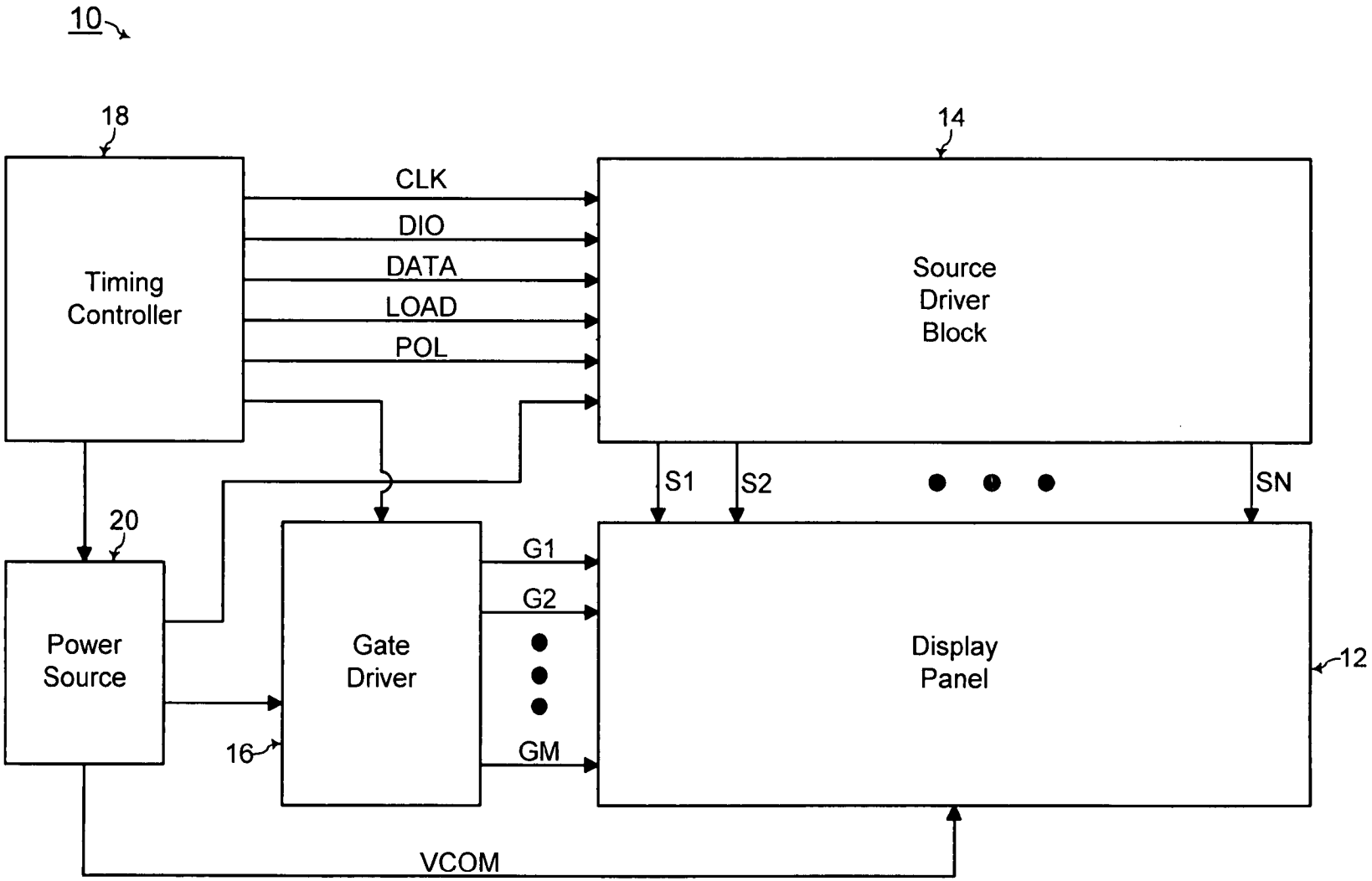
FIG. 1 (Prior Art)
FIG. 1 shows components of a display device, according to the prior art.
Figure 2:
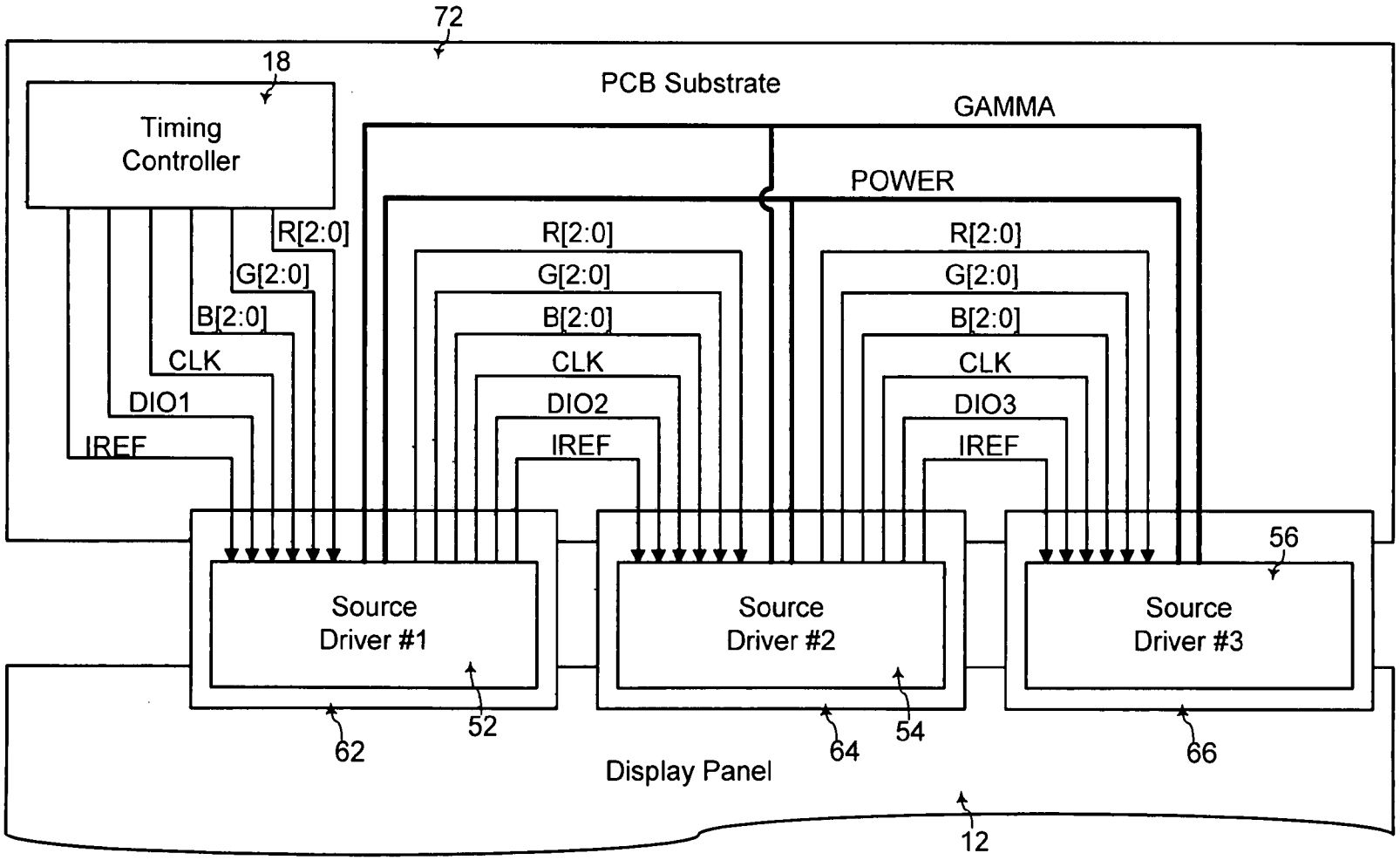
FIG. 2 (Prior Art)
FIG. 2 illustrates increased wiring for signal transmission from a timing controller to source drivers in a display device, according to the prior art.

Thus, a total current of 2*1 is consumed for signal transmission of the RGB data signals through the first, second, and third source drivers 112, 114, and 116 in FIG. 3. In contrast, a total current of 3*1 is consumed for signal transmission of the RGB data signals through the first, second, and third source drivers 52, 54, and 56 in FIG. 2. Furthermore, reduced signal wiring through the subsequent source drivers 114 and 116 in FIG. 3 in turn minimizes EMI (electromagnetic interference).

In addition, data buses are used for transmitting control signals for indicating latching, loading, and polarity in the display device of FIG. 3 during predetermined time periods A, B, and D for reducing wiring for control signals. Such reduced wiring for control signals further reduces power consumption and EMI (electromagnetic interference).

In the embodiment of FIG. 3, the physical wires (or data buses) for the first RGB data signals D1[2:0] are not present between the first and second source drivers 112 and 114. Similarly in FIG. 3, the physical wires (or data buses) for the first and second RGB data signals D1[2:0] and D2[2:0] are not present between the second and third source drivers 114 and 116.

Figure 6:
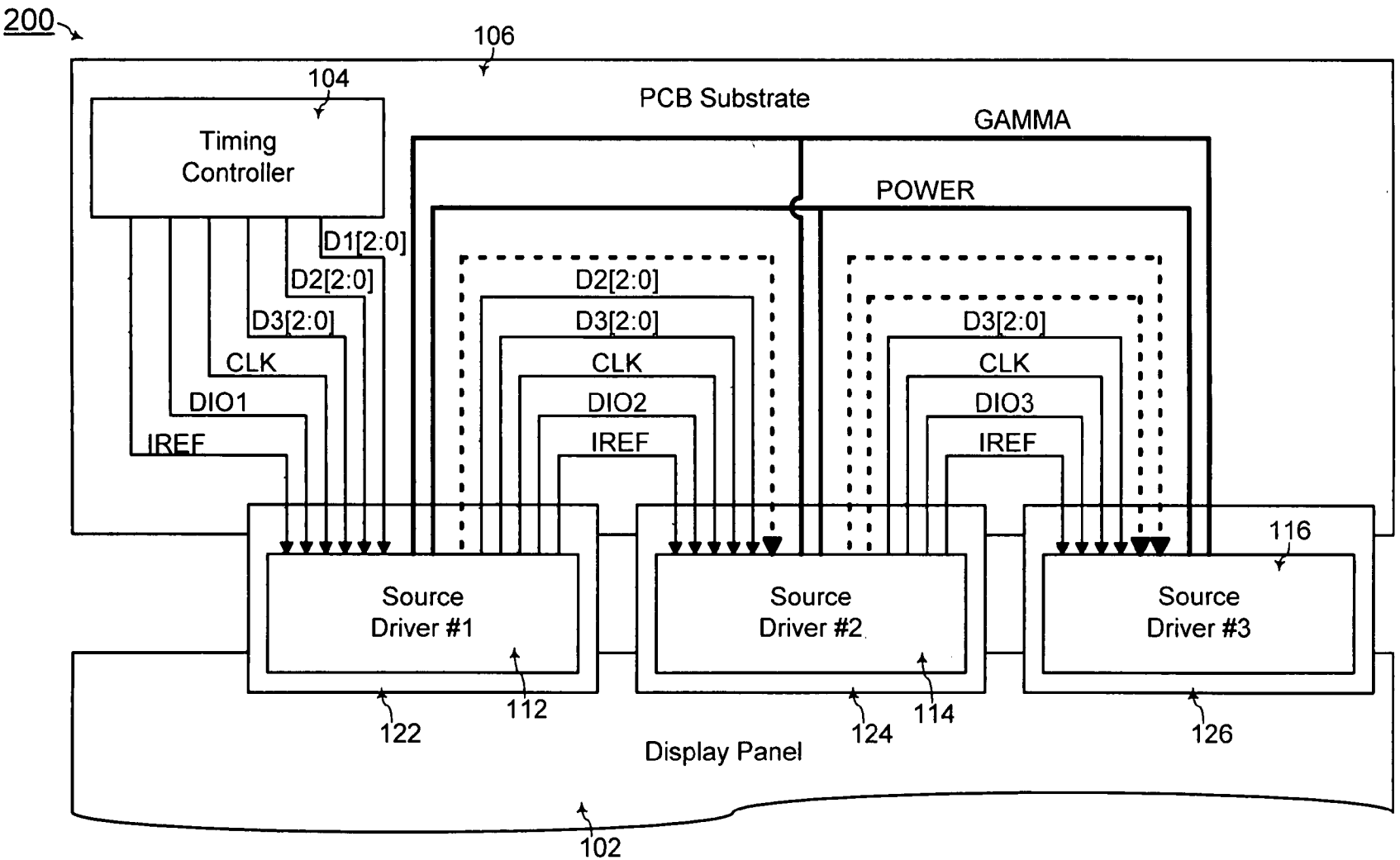
FIG. 6 shows a display device with minimized signal transmission from a timing controller to source drivers, according to another embodiment of the present invention.

FIG. 6 shows another embodiment of a display device 200 that is similar to the display device 100 of FIG. 3. However in FIG. 6, the physical wires (or data buses) are present as in FIG. 2, but such wires are just not used with no signal transmitted therein. For example, the dashed line between the first and second source drivers 112 and 114 in FIG. 6 represents wiring capable of transmitting the first RGB data signals D1[2:0]. However in FIG. 6, such wiring although disposed on the PCB substrate 106 are just not used for transmission of any signals.

Similarly, the dashed lines between the second and third source drivers 114 and 116 in FIG. 6 represent wiring capable of transmitting the first and second RGB data signals D1[2:0] and D2[2:0]. However in FIG. 6, such wiring although disposed on the PCB substrate 106 are just not used for transmission of any signals. By not being used for such signal transmission, power consumption and EMI (electromagnetic interference) are also minimized in the embodiment of FIG. 6.

Figure 7:
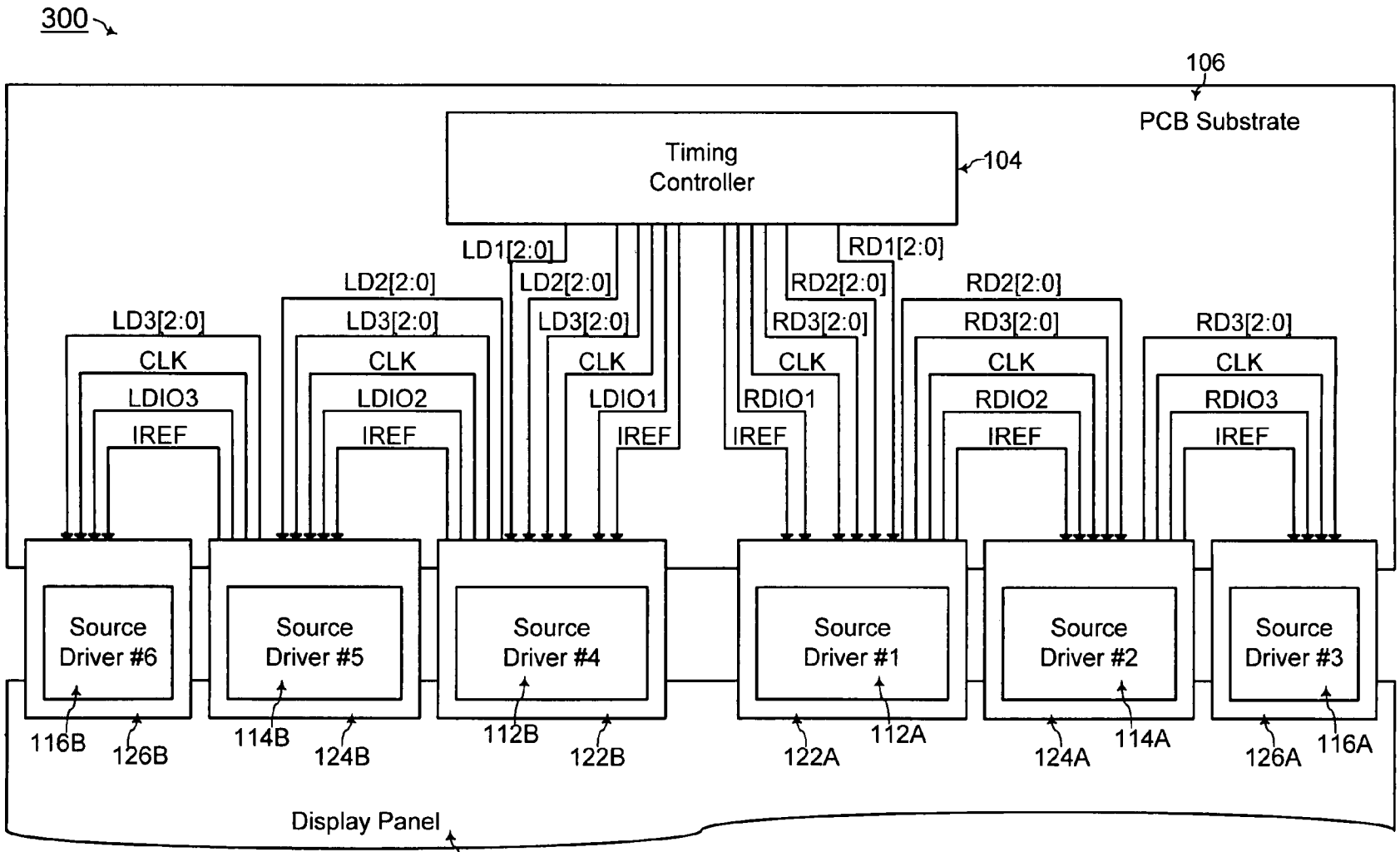
FIG. 7 shows components of a display device having a T-configuration and having minimized wiring for signal transmission from a timing controller to source drivers, according to an embodiment of the present invention.

FIG. 7 shows a display device 300 having a T-configuration according to another embodiment of the present invention. In FIG. 7, a first cascade of three source drivers 112A, 114A, and 116A are disposed to a right side of the timing controller 104, and a second cascade of three source drivers 112B, 114B, and 116B are disposed to a left side of the timing controller 104. Each of the source drivers 112A, 114A, 116A, 112B, 114B, and 116B are disposed on a respective film 122A, 124A, 126A, 122B, 124B, and 126B.

In the T-configuration of FIG. 7, signal wiring is minimized for the right data signals RD1[2:0], RD2[2:0], and RD3[2:0] sequentially through the first cascade of three source drivers 112A, 114A, and 116A toward the right side of the timing controller 104, similarly as described in reference to FIG. 3. Similarly in FIG. 7, signal wiring is minimized for the left data signals LD1[2:0], LD2[2:0], and LD3[2:0] through the second cascade of three source drivers 112B, 114B, and 116B toward the left side of the timing controller 104, similarly as described in reference to FIG. 3. Thus, the display device 300 of FIG. 7 also has minimized power consumption and EMI (electromagnetic interference).

The foregoing is by way of example only and is not intended to be limiting. For example, the present invention is described for the display devices 100, 200, and 300 in FIGS. 3, 6, and 7 that are for COF (chip on film) packaging with each source driver being disposed on a respective film. However, the present invention may also be practiced with other types of packaging such as COG (chip on glass) and TCP (tape carrier package). In addition, any number of elements as illustrated and described herein is by way of example only. Furthermore, the present invention has been described for minimizing wiring to source drivers in the display device. However, the present invention may be generalized to minimizing wiring for any type of line drivers in a display device. Additionally, the term "wire" herein may be generalized to any type of "data bus".

The present invention is limited only as defined in the following claims and equivalents thereof.

The invention claimed is:

1. A display device comprising:

a first set of data buses coupled between a timing controller and a first line driver;

a second set of at least one data bus coupled between the first line driver and a second line driver, wherein the second set has a less number of at least one data bus than the first set; and a third set of at least one data bus coupled between the second line driver and a third line driver, wherein the third set has a less number of at least one data bus than the second set.

2. The display device of claim 1, wherein the first and second line drivers are source drivers.

3. The display device of claim 1, wherein the first and second line drivers are serially coupled in cascade.

4. The display device of claim 1, wherein the first set of data buses transmits data to be used by the first and second line drivers.

5. The display device of claim 4, wherein the second set of at least one data bus transmits data to be used by the second line driver.

6. The display device of claim 5, wherein the second set of at least one data bus does not transmit data used by the first line driver.

7. The display device of claim 6, wherein the second set of at least one data bus transmits data to be used by the third line driver coupled to the second line driver.

8. The display device of claim 1, wherein a respective data bus in each of the first and second sets transmits at least one control signal during a predetermined time period and transmits color data outside of the predetermined time period.

9. The display device of claim 8, wherein the at least one control signal indicates at least one of a LATCH state, a LOAD state, and a POLARITY state for the first and second line drivers.

10. The display device of claim 1, further comprising:

a first set of at least one control bus coupled between the timing controller and the first line driver; and a second set of at least one control bus coupled between the first line driver and the second line driver;

wherein the first and second sets of control buses transmit at least one control signal from the timing controller to the first and second line drivers.

11. The display device of claim 1, wherein the timing controller and the first and second line drivers are part of the display device having a T-type serial cascade structure.

12. The display device of claim 1, wherein the display device is a LCD (liquid crystal display), and wherein the data buses of the first and second set are formed onto a PCB (printed circuit board) substrate, and wherein the first and second line drivers are disposed on a filler material.

13. A method for transmitting data signals in a display device comprising:

transmitting a first set of data signals from a timing controller to a first line driver;

transmitting a second set of at least one data signal from the first line driver to a second line driver, wherein the number of the at least one data signal in the second set is less than in the first set; and transmitting a third set of at least one data signal from the second line driver to a third line driver, wherein the number of the at least one data signal in the third set is less than in the second set.

14. The method of claim 13, wherein the first set of data signals includes data to be used by at least one of the first and second line drivers.

15. The method of claim 14, wherein the at least one data signal in the second set includes data to be used by the second line driver but not data used by the first line driver.

16. The method of claim 13, wherein the first and second line drivers are source drivers.

17. The method of claim 13, wherein a first set of data buses transmits data signals from the timing controller to the first line driver, and wherein a second set of at least one data bus transmits data signals between the first and second line drivers, and wherein the second set has a less number of at least one data bus than the first set.

18. The method of claim 17, further comprising:

transmitting at least one control signal from the timing controller to the first and second line drivers during a predetermined time period via a respective data bus in each of the first and second sets, and wherein the respective data bus transmits color data outside of the predetermined time period.

19. The method of claim 18, further comprising:

indicating at least one of a LATCH state, a LOAD state, and a POLARITY state from the at least one control signal in the first and second line drivers.

20. The method of claim 17, further comprising:

transmitting at least one control signal via a first set of at least one control bus coupled between the timing controller and the first line driver; and transmitting at least one control signal via a second set of at least one control bus coupled between the first line driver and the second line driver.

21. The method of claim 13, wherein the first and second line drivers are serially coupled in cascade.

22. The method of claim 13, wherein the timing controller and the first and second line drivers are part of the display device having a T-type serial cascade structure.

23. The method of claim 13, wherein the display device is a LCD (liquid crystal display), and wherein the data buses of the first and second set are formed onto a PCB (printed circuit board) substrate, and wherein the first and second line drivers are disposed on a filler material.

* * * * *